United States Patent [19]

Slayton

[11] Patent Number: 4,460,177

[45] Date of Patent: Jul. 17, 1984

[54] GOLF GAME

[76] Inventor: Claude J. Slayton, 1321 S. Winston, Tulsa, Okla. 74112

[21] Appl. No.: 491,354

[22] Filed: May 4, 1983

[51] Int. Cl.[3] ..... A63B 69/36

[52] U.S. Cl. ..... 273/176 FA; 273/DIG. 26; 273/180; 273/126 A

[58] Field of Search ..... 273/121 A, 121 B, 124 A, 273/176 FA, 176 F, 118 A, 119 A, 120 A, 126 A, DIG. 26, 178 R, 178 A, 179 R, 179 A, 179 B, 179 C, 179 D, 179 E, 180

[56] References Cited

U.S. PATENT DOCUMENTS 1,799,263 4/1931 Swain et al. ..... 273/176 FA 3,986,718 10/1976 Long et al. ..... 273/176 FA

*Primary Examiner*—George J. Marlo

*Attorney, Agent, or Firm*—Head, Johnson & Stevenson

[57] ABSTRACT

A golf game is played by two players putting golf balls into nine pairs of ball receiving receptacles. Each pair of receptacles is marked with two different color codes. As a result of a putted golf ball entering a color coded ball receiving receptacle, an electric solenoid turns a valve either to the right or left, which directions correspond to the two different color codes. The valves control the flow of counters along intersecting channels which terminate in a receiving area for accumulating the counters to provide a score for each player.

10 Claims, 8 Drawing Figures

GOLF GAME

SUMMARY OF THE INVENTION

The object of this invention is to provide a game of amusement and skill. Although one person can play the game of this invention it is better suited for two, although it is to be understood that the game is expandable to more than two players.

The game of this invention is particularly described for use with a golf ball and putter although it is to be understood that other forms of driven objects, balls or disks, are capable of utilizing the concepts of the invention.

The game comprises a framework having a putting surface in which a plurality of receptacles located atop a ramp are adapted to receive a putted golf ball. The receptacles have markings and/or are color coded for each player. Below each receptacle is a switch which activates an electrical circuit upon contact with the golf ball. The ramp and the portion leading thereto may be covered with an artificial grass or carpet. A display board is vertically oriented as apart of the framework and includes a plurality of viewable intersecting channels that are oriented at an angle to the vertical. Scoring channels for each player are interconnected with portions of the intersections. Each of the intersections are marked with indicia which correlate with the indicia or coded markings adjacent each receptacle. A plurality of counter-objects or golf balls are positioned in a channel that intersects with the top most intersection of the channels. A wing valve is located at each intersection and normally blocks same, but is adapted to receive a counterball. Each of the wing valves are adapted to pivot in electrical response to a corresponding activation switch from a given receptacle which unblocks the intersection and allows a player's counterball to drop to a next intersection or to a corresponding scoring channel. The object of the game being that the player with the most counterballs will be declared the winner. The wing valves are pivoted by either a first or a second solenoid each which is in response to a given receptacle activation switch. The skill of the player being to direct the driven object towards his particular coded receptacle with the counterball entering his scoring channel and/or to block the scoring of his opponent.

DETAILED DESCRIPTION OF THE PREFERRED EMBODIMENT

Before explaining the present invention, in detail, it is to be understood that the invention is not limited in its application to the details of construction and arrangement of parts illustrated in the accompanied drawings, since the invention is capable of other embodiment and being practiced or carried out in a variety of ways. Also, it is to be understood that the phraseology or terminology employed herein is for the purpose for description and not of limitation.

Figure 1:
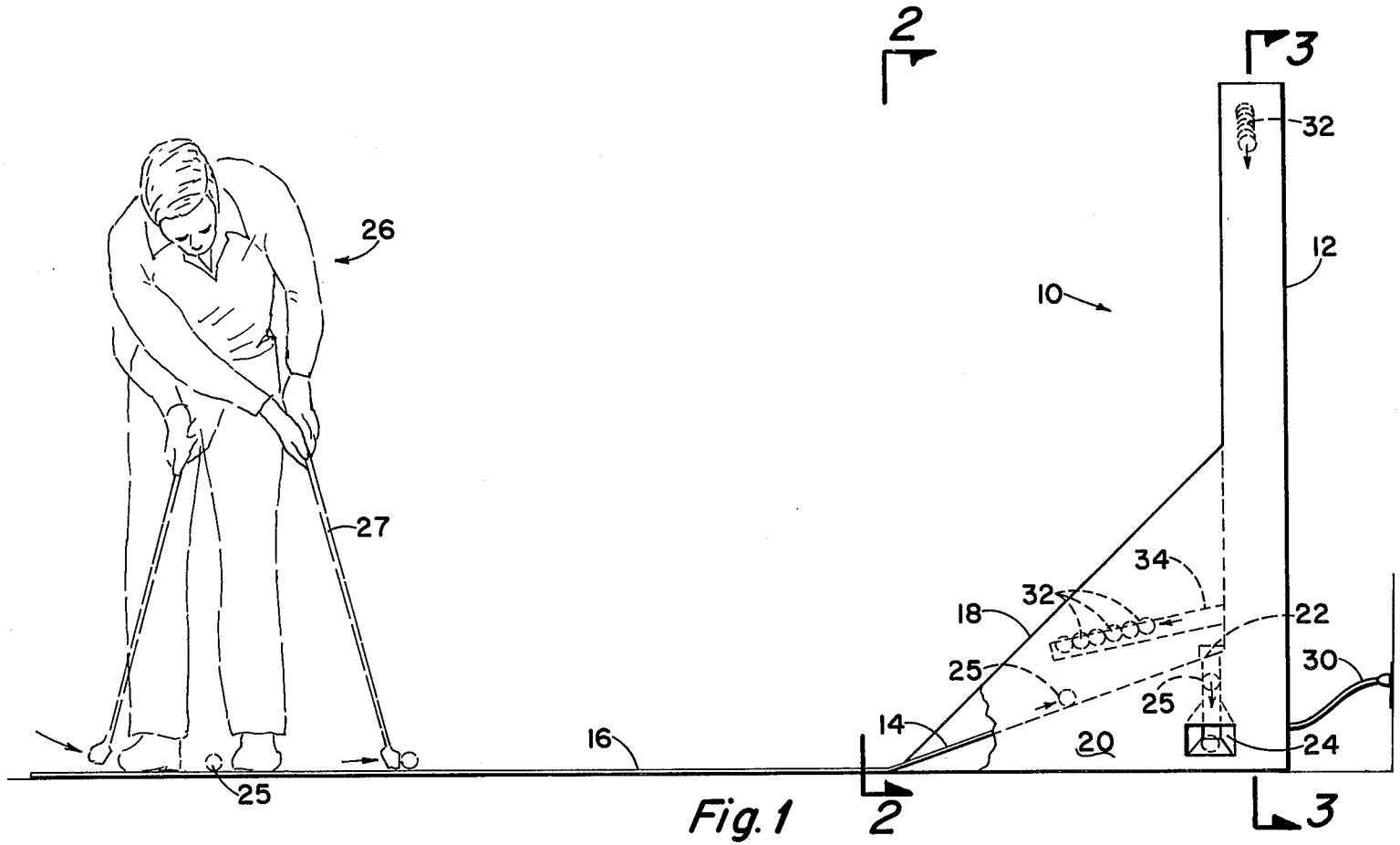
FIG. 1 is a side elevational view of the game of this invention.

Referring now to FIG. 1, the game of this invention is generally designated by the numeral 10 and includes an upright portion 12, an inclined ramp 14 and a putting surface 16. Side boards 18 and 20 are located on each side of the ramp 14. At the end of the ramp are a plurality of receptacles 22, the details of which will be hereafter described. The receptacles connect with an outlet 24 which may include means for directing the golf balls 25 back to the player generally designated by the numeral 26, who uses a putter 27 as is well known. Suitable electrical connection 30 is provided for actuation of the scoring means as hereafter described. A plurality of counterballs 32 are provided in the machine and are adapted to be received, during the play, for each player in a scoring receptacle 34. The player with the greater number being declared the winner.

Figure 2:
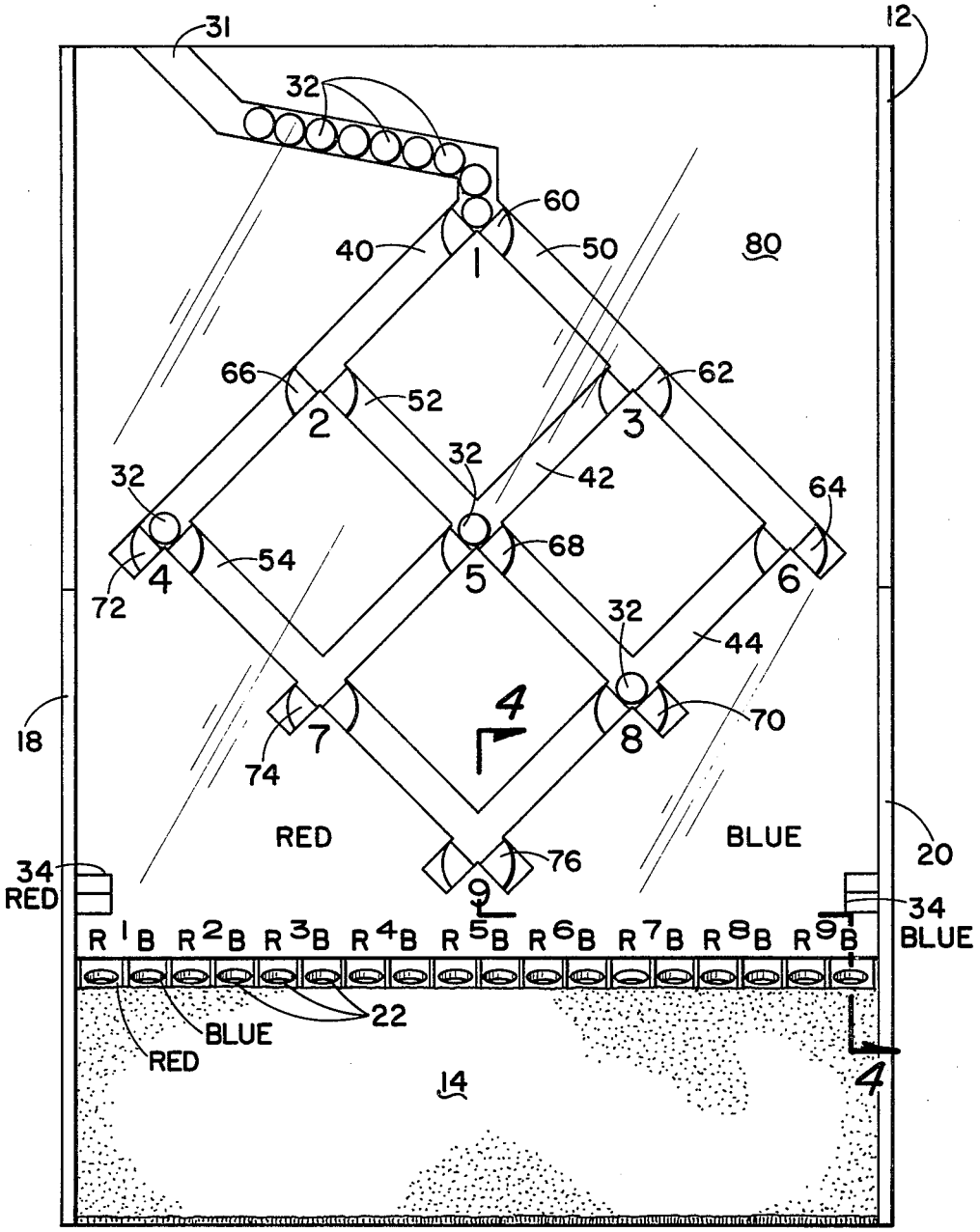
FIG. 2 is a front elevational view taken along line 2—2 of FIG. 1.

FIG. 2 represents the players view of the components of the game shown and displayed on framework 12. At the terminus of ramp 14 are a plurality of receptacles 22 which are designated by the indicia "1" through "9". Each of the receptacles are color coded red and blue, designated "R" and "B" respectively. For each numeral there is a corresponding red and blue (R and B) receptacle. The vertical board itself includes an opening 31 in the top thereof to receive a plurality of counterballs 32. The mechanism of the game comprises a plurality of angularly oriented and intersecting channels 40, 42, 44, 50, 52 and 54. At the intersection of each channel is a wing valve, for example, at the intersection of channels 40 and 50 is a wing valve 60. At the intersection of channels 42 and 50 is a wing valve 62, at the intersection of channels 44 and 50 is wing valve 64. At the respective intersections with channel 52 are respective wing valves 66, 68 and 70. At the intersections with channel 54 are respective wing valves 72, 74 and 76. The game board includes a cover 80 which is translucent opposite the various channels and may be opaque for the remainder of the board. The portions designated "red" and "blue" may be colored accordingly as shown.

Figure 3:
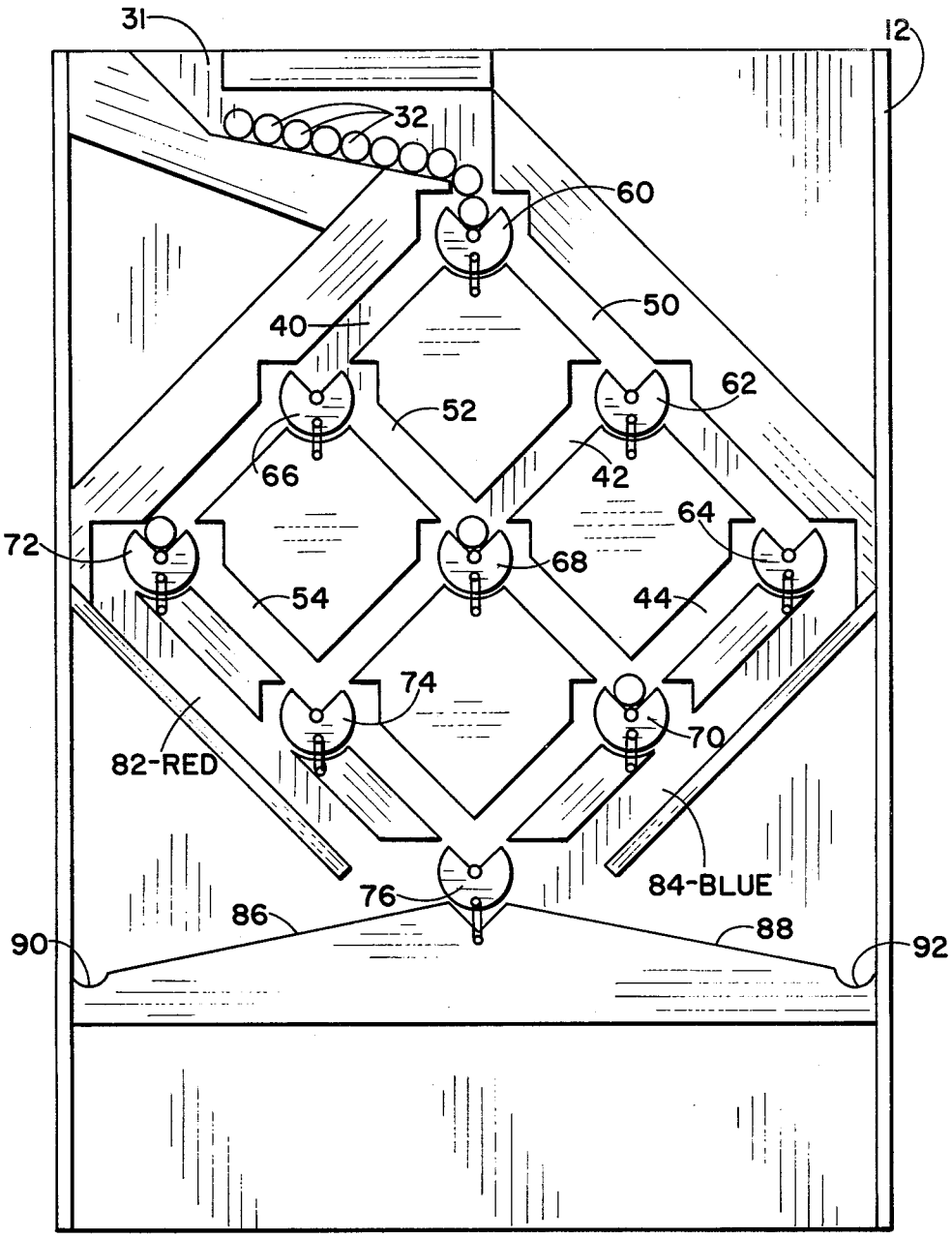
FIG. 3 is a front elevational view taken along line 3—3 of FIG. 1.

FIG. 3 is another view with cover 80 removed to describe the game board of the invention and the various channels as previously described. A scoring channel 82-red intersects with the wing valves 72, 74 and 76 while scoring channel 84-blue intersects with wing valves 64, 70, and 76. Ramps 86 and 88 are provided so that the counterballs may roll to the respective receptacle openings 90 and 92.

Figure 4:
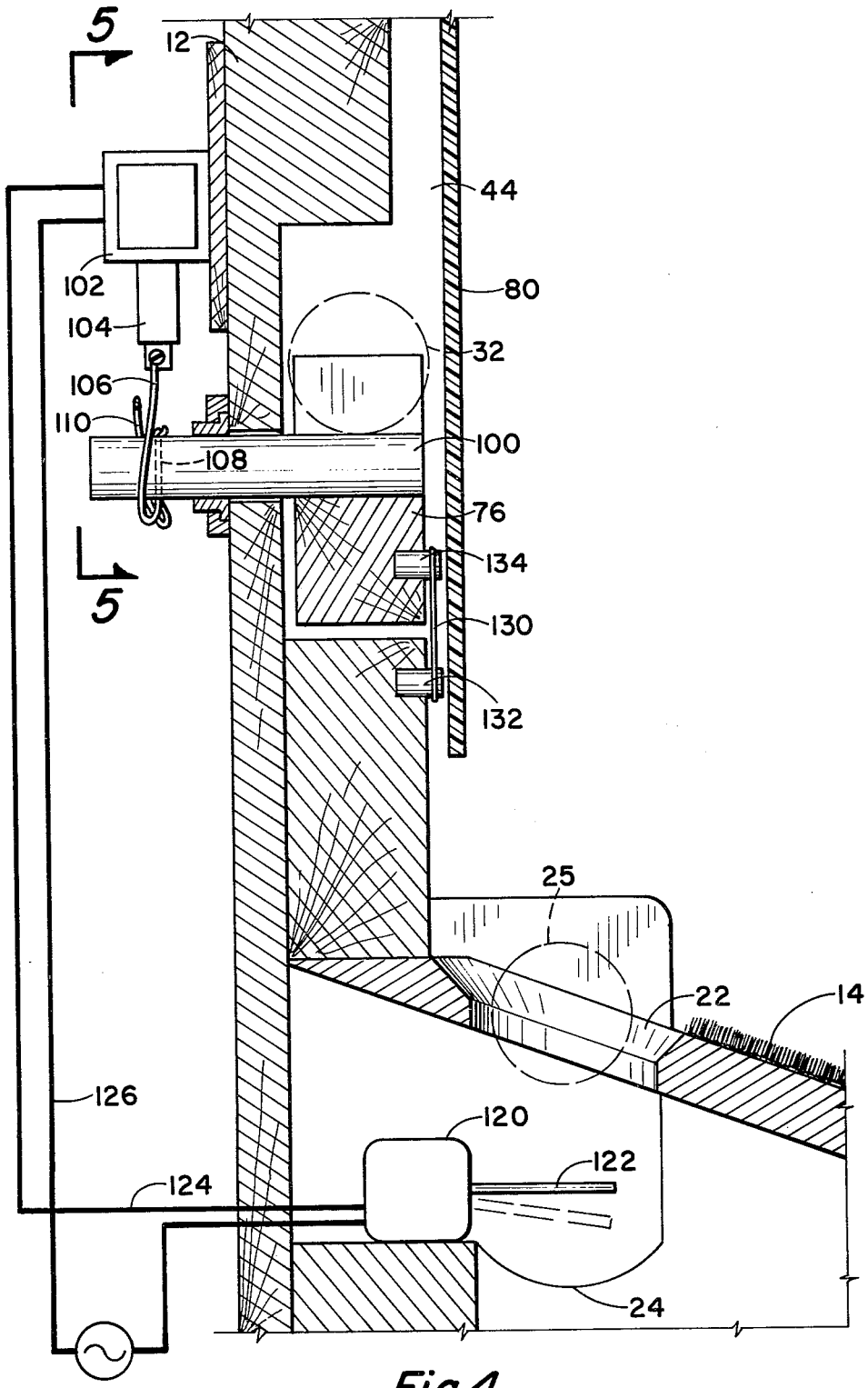
FIG. 4 is a partial sectional view taken along the line 4—4 of FIG. 2.

The view of FIG. 4 provides description of wing valve 76 which is representative of all of the wing valves and which include a pivot shaft 100 extending through appropriate bushings through framework 12. A solenoid 102 which is one of a pair for each wing valve is attached to the framework 12. The solenoid plunger 104 is connected to the shaft 100 by a flexible cord member 106 which extends around the shaft 100 through an opening 108 therethrough and knotted at the end. A cord 110 is similarly attached to the shaft on the other side and being connected to the second solenoid, not shown in this view. Below each receptacle 22 is an activator switch 120 having an arm 122 which golf ball 25 will hit supplying electrical energy by way of wires 124 and 126 to the solenoid 102. Each wing valve is maintained in its normal intersection blocking position by a resilient band 130 which connects around peg 132 affixed to the framework 12 and peg 134 affixed wing valve 76.

Figure 5:
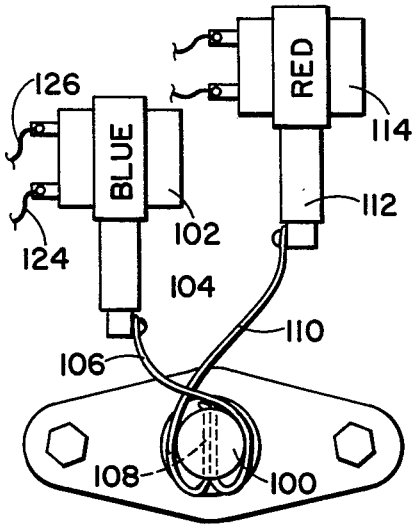
FIGS. 5, 6 and 7 are views essentially taken along the line 5—5 of FIG. 4 describing the pivoting action of wing valve of this invention.
Figure 6:
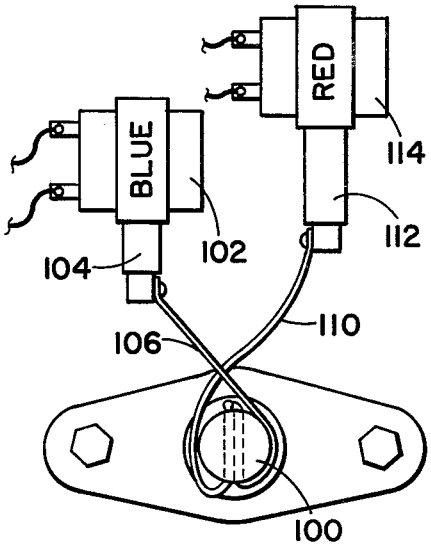
Figure 7:
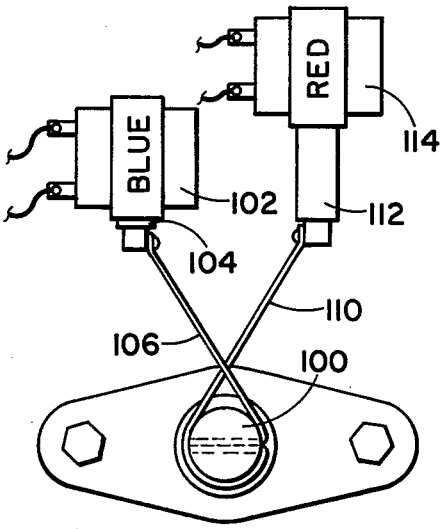
Figure 8:
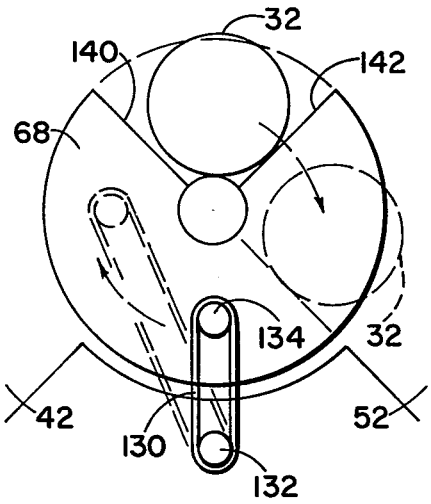
FIG. 8 is a front partial view showing the operation of the wing valve during the play of the game.

Referring now to FIGS. 5–7, the sequence of operation is shown when the players' golf ball has entered receptacle 22-B which, upon activation of the switch 120 will send electrical current to operate solenoid 102. As the solenoid 102 actuates, its plunger 104 will move vertically upward carrying with it cord 106. Because of pre-designated slack in 106, half travel of the plunger 104 will take up the slack with the remaining half movement acting to pivot shaft 100 90° as shown in FIG. 7. Sufficient slack is provided in cord 110 relative to the shaft 100 such that the rotation of the shaft nearly takes up the slack therein, again, as shown in FIG. 7. FIG. 8 is a frontal view of wing valve 68 which operates relative to channels 42 and 52 and further describes the pivoting action of the valve. In its normal position the valve 68 includes an opening formed by surface 140 and 142 which will entrap a counterball 32 therein. In the view shown the wing valve has been pivoted to the right allowing the counter ball 32, showing dotted, to drop by gravity into channel 52, where the counter ball will be stopped by the next wing valve 70 (See FIG. 3).

OPERATION

The object of the game is for each player to accumulate as many of the counterballs 32 to his or her respective scoring channels 82 or 84 as the case may be. To begin the game, one player is designated for the color red and the other player designated for the color blue. Accordingly, the red player will attempt to putt the golf ball into the red channels, i.e. one red, two red, three red, etc. which in turn will cause the respective wing valves to pivot in a counter-clockwise direction, thus directing the counter balls 32 toward the red side scoring channel. Likewise, the blue player will attempt to putt his golf ball into the blue receptacles 22 causing the respective wing valve to pivot in a clockwise direction toward the blue scoring channel. The winner, of course, being that player that has accumulated the majority of counterballs 32.

What is claimed is:

1. A game for one or more players comprising:

a vertically oriented framework, a display formed as a part of said framework comprising a plurality of intersecting channels for the travel of counter objects by gravity, said channels oriented at an angle to said vertical, a scoring channel for each player of said game, each said scoring channel connected at the bottom with one or more of said intersecting channels, an inlet channel to receive one or a plurality of said counter objects, said inlet channel being in communication with a top most intersection of said intersecting channels; valve means at each intersection of said channels to control the direction of downward movement of said counter objects; and a plurality of coded receptacles for a player driven object, an activator means within each receptacle actuated by said driven object; means to connect each of said activator means with a given valve means.

2. A game of claim 1 wherein said intersecting channels and said inlet channel are visible to said players.

3. A game of claim 1 wherein said driven objects are golf balls putted by said players.

4. A game of claim 3 wherein said counter objects are golf balls.

5. A game of claim 3 including an inclined ramp leading to said receptacles and a putting surface forward of and including said ramp.

6. A game of claim 1 wherein said driven objects are discs.

7. A game of claim 1 including means to receive said counter objects for counting.

8. A game of claim 1 wherein said valve means is actuated by electrically activated solenoids.

9. A game of claim 1 including means to return said driven objects back to each player.

10. A game for two players comprising:

a vertically oriented framework, a display formed in the upper part of said framework comprising a plurality of intersecting channels, visible to said players, said intersecting channels oriented at a 45° angle to said vertical, a scoring channel for each player, one on one side connected with each bottom-most intersection on said one side, and one on the other side connected with each bottom-most intersection on said other side, different color coded indicia for each player to identify that persons respective side, a visible inlet channel to receive a plurality of counter balls which are of a size to travel by gravity along said channels, said inlet channel in communication with the topmost intersection of said intersecting channels, a numbered rotatable valve located at each intersection of said channels, said valve having means to receive and retain a counter ball, and to control the direction of downward movement of said counter object;

a ramp at the bottom of said framework, a putting surface before and including said ramp;

a plurality of receptacles at the terminus of said ramp to receive a golf ball putted by said players, there being a pair of receptacles numbered to correspond with each of said numbered rotatable valves, one receptacle of each said pair being identified by indicia corresponding to one of said color coded indicia;

a pair of electrically actuated solenoids for each of said valves, one of said solenoids having means to rotate said valve in one direction according to one of said color codes and the other in the other direction according to the other of said color codes, a switch within each receptacle actuated by said golf ball, and means interconnected with said switch to actuate said solenoid and rotate said valve in the direction corresponding to the color code of said receptacle, and means to receive said counter balls for each of said players.

* * * * *